United States Patent [19]

Kurokawa et al.

[11] 4,025,815

[45] May 24, 1977

[54] PICK-UP TUBE HAVING PHOTOCONDUCTOR ON ZINC OXIDE LAYER

[75] Inventors: Hiromichi Kurokawa, Yokahama; Haruhiko Okada, Tokyo; Masaru Yamazaki, Sagamihara, all of Japan

[73] Assignee: Sony Corporation, Tokyo, Japan

[22] Filed: June 13, 1975

[21] Appl. No.: 586,599

[30] Foreign Application Priority Data

June 14, 1974 Japan ..... 49-67954

[52] U.S. Cl. ..... 313/371; 313/385

[51] Int. Cl.[2] ..... H01J 31/38; H01J 31/46

[58] Field of Search ..... 313/386, 385, 384, 390, 313/370, 450, 371; 358/46

[56] References Cited

UNITED STATES PATENTS

| | | | |
|---|---|---|---|
| 2,687,484 | 8/1954 | Weimer | 313/386 |
| 3,015,746 | 1/1962 | Lubszynski | 313/386 |
| 3,020,442 | 2/1962 | Nicholson et al. | 313/385 X |
| 3,087,985 | 4/1963 | Heijne et al. | 313/371 X |
| 3,108,906 | 10/1963 | Scharrer et al. | 313/450 X |
| 3,303,344 | 2/1967 | Simms | 313/385 X |
| 3,405,298 | 10/1968 | Dresner | 313/385 |
| 3,772,552 | 11/1973 | Kubota | 313/371 |
| 3,854,069 | 12/1974 | Tagawa | 313/365 X |
| 3,890,525 | 6/1975 | Hirai et al. | 313/386 |
| 3,922,579 | 11/1975 | Goto et al. | 313/386 X |

OTHER PUBLICATIONS

Heslop and Robinson, Inorganic Chemistry, second edition; Elsevier Publishing Company; 1963; p. 10 cited.

*Primary Examiner*—Robert Segal
*Attorney, Agent, or Firm*—Lewis H. Eslinger; Alvin Sinderbrand

[57] ABSTRACT

In a television pickup tube, a target comprises a photoconductive material such as antimony trisulfide, amorphous selenium or the like arranged on a transparent zinc oxide layer which is formed adjacent to a transparent electrode on a transparent faceplate or substrate. The transparent electrode may be etched so as to form a pair of electrodes each connected to a signal deriving terminal in the case where the target structure is for a color television pickup tube.

8 Claims, 10 Drawing Figures

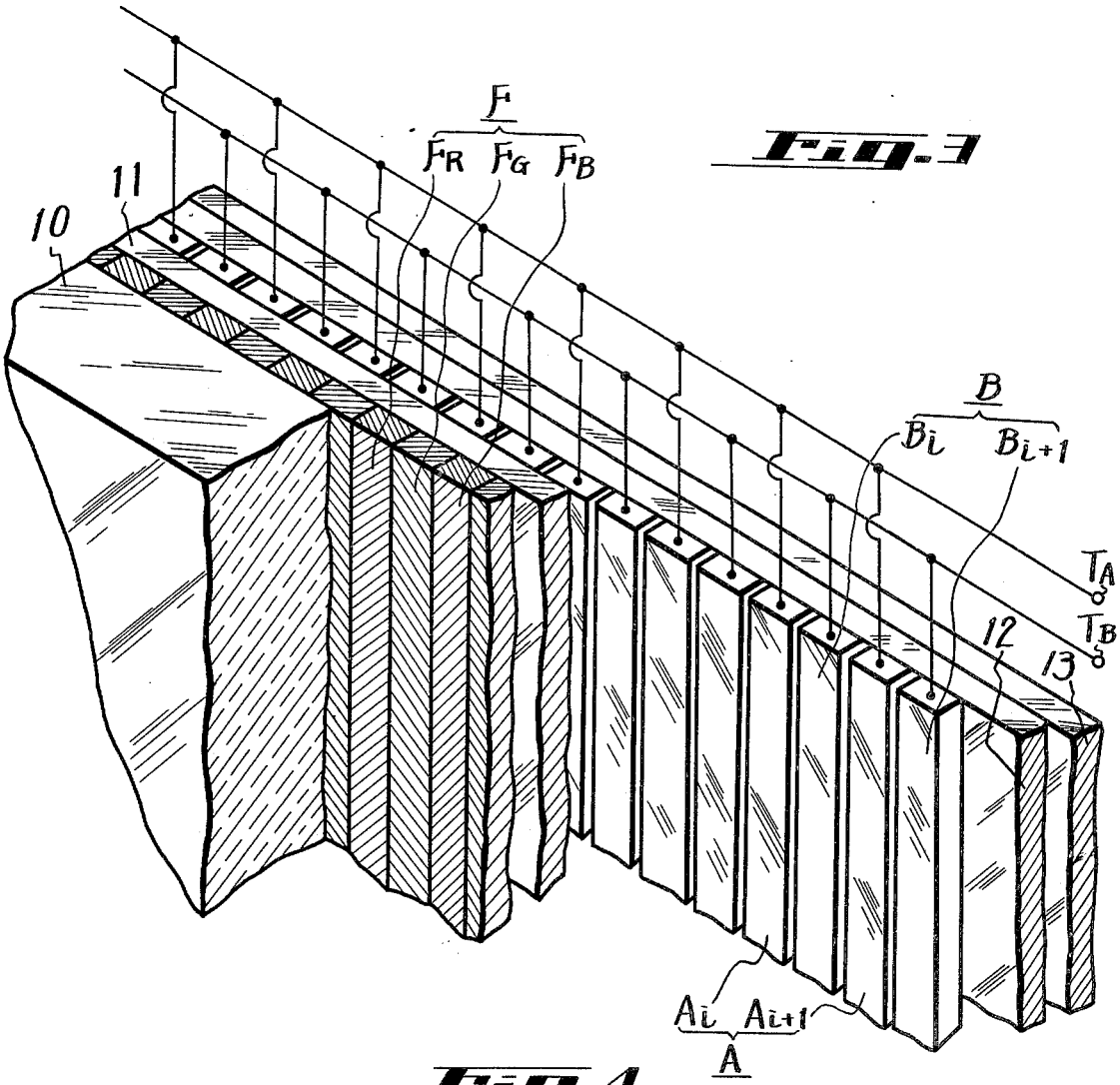
Fig. 3
Fig. 4
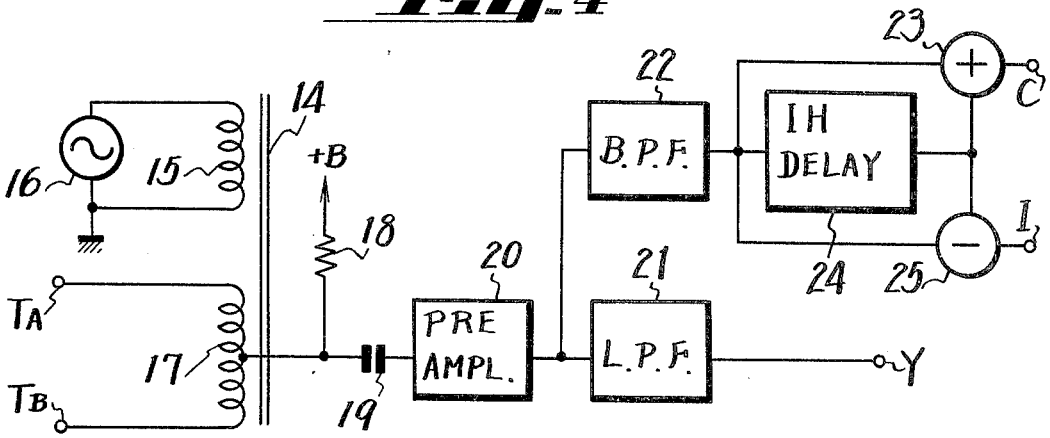

PICK-UP TUBE HAVING PHOTOCONDUCTOR ON ZINC OXIDE LAYER

BACKGROUND OF THE INVENTION

1. Field of this Invention

This invention relates generally to a target structure for an image pickup tube, and more particularly to such a target structure that employs, as a photo-conductive material, either amorphous selenium or antimony trisulfide.

2. Description of the Prior Art

There have been proposed many types of target structures for use in a television pickup tube. For example, antimony trisulfide is well-known as a photo-conductive material in a target structure. The target structure is usually formed of a face-plate made of glass *a*, transparent electrode made of tin-oxide usually called Nesa (trade mark), and a photo-conductive layer of antimony trisulfide. A pickup tube which employs the target structure above described is widely used in this field but it is known that the dark current characteristics and residual image characteristics thereof are less than desirable. Further dust undesirably attaches to th surface of the tin-oxide during fabrication and deteriorates video signals from the image pickup tube. Another type of a prior art target structure employs principally amorphous selenium as its photo-conductive material. The improvement of residual image characteristics is as expected by using this photo-conductive material, but the shortened life time of an image pickup tube based on the low crystallizing temperature of amorphous selenium has prevented its practical use.

SUMMARY OF THE INVENTION

Accordingly, it is an object of the invention to provide a target structure for use with an image pickup tube which has improved dark current characteristics and residual image characteristics and which is endowed with a long useful life.

According to an aspect of the present invention there is provided a target structure for use with an image pickup tube in which a zinc oxide (ZnO) layer is provided between the transparent electrode and the P-type photo conductive layer of a conventional target structure. Either amorphous selenium (Se) or antimony trisulfide ($Sb_2S_3$) is suitable as a photo-conductive material. When the amorphous selenium is used, another material is doped thereinto so as to improve respective characteristics of the target. By way of example, arsenic (As) and sulphur (S) are used for obtaining long life and tellurium (Te) is used for good response to an incident light of relatively long wave length. Since the zinc oxide (ZnO) is selected to have a resistance value between those of a conductor and a resistive body, the target structure can be easily manufactured by using the zinc oxide in a target structure of a color image pickup tube such as is disclosed in the U.S. Pat. No. 3,772,552.

The above, and additional and other objects, features and advantages of the invention, will become apparent from the following description taken in conjunction with the accompanying drawings.

BRIEF DESCRIPTION OF THE DRAWINGS

FIG. 3 is a perspective view, partially in cross section, showing a target structure of the color image pickup tube to which the present invention is applied;

FIG. 4 is a block diagram showing a circuit used in the color image pickup tube shown in FIG. 3;

DESCRIPTION OF THE PREFERRED EMBODIMENTS

Figure 1:
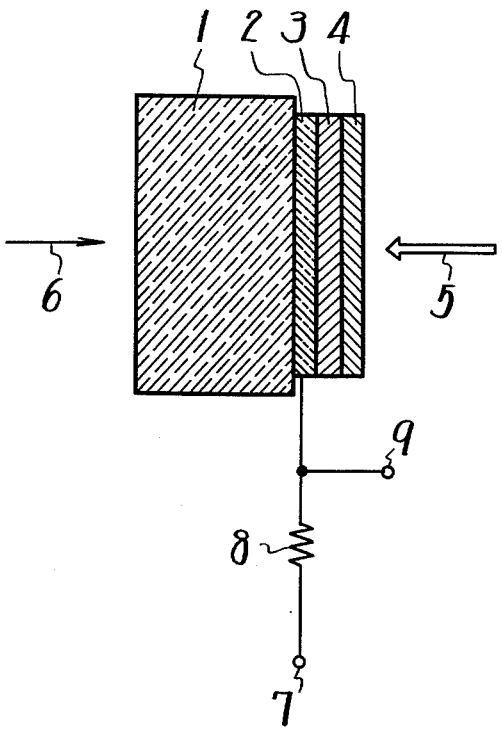
FIG. 1 is a cross-sectional view showing an embodiment of the target structure according to the present invention.

FIG. 1 shows a basic structure of a target according to this invention. In FIG. 1, reference numeral 1 designates a glass plate which is usually referred to as a face plate. A transparent electrode 2 which is made of, for example, tin-dioxide ($SnO_2$) is applied to the rear surface of the glass plate 1 by, for example spraying. A zinc oxide (ZnO) layer 3 is coated on the transparent electrode 2 and has a thickness of about 100 ~10000 A (angstrom). In this case, layer 3 may be applied by the reactive spattering method in argon gas. Finally, a photo-conductive layer 4 is formed on the zinc oxide layer 3 and is made of, for example, antimony trisulfide ($Sb_2S_3$). The target structure thus formed is scanned with an electron beam from the direction shown by an arrow 5 in FIG. 1 according to the well-known manner, while light informations are focused or projected through the glass plate 1 and so on onto the photo-conductive layer 4 from the front surface of the glass plate 1 in the direction shown by an arrow 6 in FIG. 1. The transparent electrode 2 is supplied with a bias voltage from a voltage source terminal 7 through a resistor 8, and an output terminal 9 is led out from the transparent electrode. 2.

Figure 2:
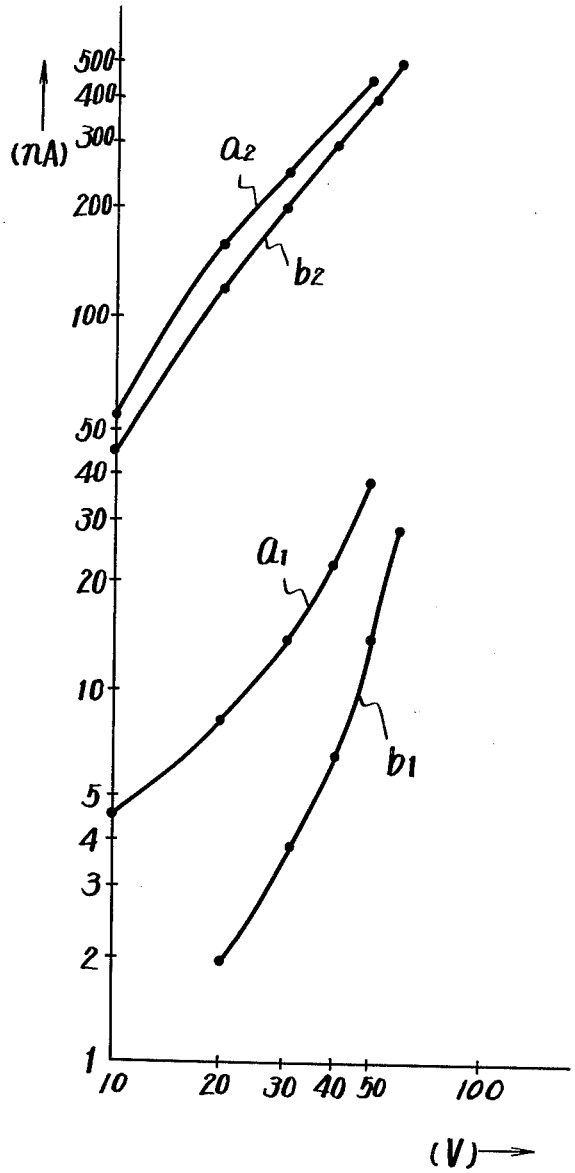
FIG. 2 is a graph showing the voltage-current characteristics of a pickup tube in which the target structure shown in FIG. 1 is used.

FIG. 2 is a graph showing the V-1 or voltage-current characteristics of an image pickup tube using the target structure according to the invention and of a conventional image pickup tube, respectively. The conventional image pickup tube was one having a target structure similar to that shown in FIG. 1, but with the zinc oxide layer 3 being omitted. In the graph of FIG. 2, the abscissa represents the target voltage in volts (V) and the ordinate represents the target current in nano ampere (*n*A). In FIG. 2, a curve $a_1$ shows the V-I characteristics of the conventional image pickup tube when no light is incident on the target and a curve $a_2$ shows the V-I characteristics of the conventional image pickup tube when light is indicent on the target with an illumination intensity of 10 lux, while curves $b_1$ and $b_2$ show the V-I characteristics for the image pickup tube having the target structure of the invention shown in FIG. 1 under the same conditions, respectively. From the graph of FIG. 2, it is noted that the target structure according to the invention as shown in FIG. 1 has characteristics closer to that of a target structure of the blocking type due to its P-type photo-conductive layer and N-type zinc oxide layer, and that the V-I characteristics of the target when exposed to incident light are not deteriorated and that the dark current characteristics are improved.

The following table I shows the residual image characteristics of the conventional image pickup tube and of the novel image pickup tube in which the target structure of this invention shown in FIG. 1 is employed, respectively.

Table I

| | after 3 fields | after 15 fields | after 63 fields |
|---|---|---|---|
| Prior Art | 17 % | 5.4 % | 2.0 % |
| This Invention | 17 % | 3.4 % | 0.56 % |

From the above Table I, it may be understood that the target structure of the invention contributes greatly to improvement of the residual image characteristics of the image pickup tube using the same.

The target structure having a zinc oxide layer according to the invention can be employed as the target structure in the color image pickup tube disclosed in the U.S. Pat. No. 3,772,552. In that case, as shown in FIG. 3, the target structure of the color image pickup tube comprises a face plate 10, a color filter F, a thin glass plate 11, a pair of index electrodes A composed of electrode elements $A_1, A_2, \ldots A_n$ and B composed of electrode elements $B_1, B_2, \ldots B_n$, a zinc oxide layer 12, and a photo-conductive layer 13, respectively. The electrodes A and B are transparent conductive layers, for example, formed of tin-oxide including antimony, and they are arranged with their elements parallel and alternated, for example, in an order which may be $A_1, B_1, A_2, B_2, \ldots A_i, B_i, \ldots A_n, B_n$. The electrodes A and B are shown respectively connected to terminals $T_A$ and $T_B$ for connection with external circuits. In this case, the electrodes A and B are disposed so that the longitudinal axes of their elongated elements may cross the horizontal scanning direction of the electron beam.

The filter F which is separated from electrodes A and B by glass plate 11 is made up of red, green andd blue color filter elements $F_R$, $F_G$ and $F_B$ arranged in a repeating cyclic order of $F_R, F_G, F_B, F_R, F_G, F_B \ldots$ and disposed parallel to the length of the elements of electrodes A and B in such a manner that each triad of red, green and blue color filter element $F_R$, $F_G$ and $F_B$ may be opposite and corresponds to a pair of adjacent electrode elements $A_1$ and $B_1$. So long as the elements of the electrodes A and B and of optical filter F are aligned with each other in the longitudinal direction, that is, extend parallel to each other, and each triad of filter elements $F_R$, $F_G$ and $F_B$ has a pitch, that is extends over a lateral distance, that is equal to the pitch or lateral distance of the respective pair of electrode elements $A_1$ and $B_1$, the relative lateral positioning of the color filter elements and the electrode elements is not critical. The color image pickup tube using the target structure shown in FIG. 3 is connected with the circuit shown in FIG. 4 as an external circuit.

In FIG. 4, reference numeral 14 designates a transformer whose primary winding 15 is connected to a pulse signal source 16 whose polarity is reversed at each horizontal scanning. A secondary winding 17 of the transformer 14 is connected at its opposite ends to the terminals $T_A$ and $T_b$ of the target shown in FIG. 3. A mid tap of the secondary winding 17 is supplied with a target bias + B through resistor 18 and connected with a signal circuit through a capacitor 19 as shown in FIG. 4. The signal passed through the capacitor 19 is supplied through a pre-amplifier 20 to a low pass filter 21 and a band pass filter 22. The output signal from the band pass filter 22 is supplied to an adder 23, a delay line 24 of one horizontal scanning period (1H) and a subtracter 25, . The signal from the delay line 24 is fed to the adder 23 and the subtracter 25. Thus, a chrominance signal C is obtained from the adder 23, an index signal I is obtained from the subtracter 25, and a luminance signal Y is obtained from the low pass filter 21.

Since the operation of the color image pickup tube using the target shown in FIG. 3 is described in the U.S. Pat. No. 3,772,552, it will not be repeated herein. However, by the provision of the zinc oxide layer 12 in the target shown on FIG. 3, in addition to the advantages described in connection with FIG. 1, the signals between the electrodes A and B can be picked up through the zinc oxide layer 12, so that the gap between the electrodes can be widened to some extent for facilitating the manufacture thereof. This is very advantageous because the resistance value of the photo-conductive layer 13 is very much in the lateral direction, so that the informations of the photo-conductive layer 13 corresponding to the gaps between the electrodes A and B can not reach the electrodes A and B if the zinc oxide layer 12 is not provided. By way of example, if the zinc oxide layer 12 is provided, the gap between the two transparent electrodes A and B could be widened to be about $7\mu$ (micron) without deteriorating the operation of the color image pickup tube. It is sufficient that the surface resistivity of the zinc oxide layer 12 is from $10^6$ $\Omega$ to $10^{15}$ $\Omega$.

Another embodiment of the invention will now be described with reference to FIG. 5, in which a base plate, through which light may pass, such as a glass plate 30, is provided. A light-permeable conductive layer or electrode 31 made of, for example, $SnO_2$ or $In_2O_3$, is formed on one surface of the glass plate 30, a transparent zinc oxide (ZnO) layer 32 is formed on the layer 31, and an amorphous selenium layer 33 containing suitable amounts of at least arsenic and sulphur is formed on the layer 32. If necessary, an antimony trisulfide ($Sb_2S_3$) layer 34 may be formed on the layer 33 for inhibiting secondary election emissions from layer 33. Thus, a target structure 35 for an image pickup tube is formed.

When the amorphous selenium layer 33 with the arsenic and sulphur added thereto is used as the photoconductive material, it is prevented from being crystallized within an effective temperature range, and hence the life span of the image pickup tube can be prolonged. Further, the residual image characteristics can be made to correspond to those obtained when using only amorphous selenium. For the foregoing reason, it is preferred that the amount of arsenic and sulphur added to the amorphous selenium as arsenic trisulfide is 5~25 weight percents. As the added amount of arsenic and sulphur increases, the life span is prolonged. However, if the added amount increases too much, the sensitibity is deteriorated. Upon manufacturing, it is effective to add the arsenic and sulphur to the selenium at the same time. It is also possible to add a suitable amount of tellurium Te to the selenium in addition to the arsenic and sulphur. By the addition of tellurium, the photo-conductive material has increased sensitivity to the longer wavelength (red waves) of light. Further, it is preferred that the tellurium be added near the ZnO layer 32 indicated by the dotted area *t* on FIG. 5.

Table II

| | | Se | Se : As 10Wt % | Se : As 20 Wt $\mu$ | Se : $As_2S_3$ 6Wt % | Se : $As_2S_3$ 12Wt % | Se : $As_2S_3$ 25Wt % |
|---|---|---|---|---|---|---|---|
| Sensitivity | | 1 | ~0.7 | ~1.5 | ~0.8 | ~0.7 | 0.4 |
| Residual Image | | Lower than 10% | Lower than 10% | Several ten % | Lower than 10% | Lower than 10% | Lower than 10% |
| Life time at 80° C | on $SnO_2$ | Hour 0~0.5 | Hour 0~1 | Hour 2~3 | Hour 1~2 | Hour 10~20 | More than Several Hundred Hours |
| | on ZnO | Hour 1~2 | — | — | Hour 50~100 | More than Several Hundred Hours | More than Several Hundred Hours |

The above Table II shows the sensitivities, residual images and life times of the prior art image pickup tube using the conventional photo-conductive material which has the amorphous selenium as its main part and of the image pickup tube using the photo-conductive material of the present invention. As as the prior art photo-conductive material, only the amorphous selenium (Se); the mixture of Se and As (Se : As) which consists of the amorphous selenium and 10 weight % of arsenic; and the mixture of Se and As (Se : As) which consists of the amorphous selenium and 20 weight % of arsenic are selected, respectively, while as the photo-conductive material of this invention, in the mixture of the amorphous selenium with the addition of arsenic and sulphur (Se : $As_2S_3$), the amount of added $As_2S_3$ is selected as 6 weight %, 12 weight and 25 weight %, respectively. Further, in Table II, the sensitivity has been assigned the value 1 when the photo-conductive material contains only the amorphous selenium, the residual image is given as the percent attenuation of photo-current after three fields, and the life time is given for the temperature of 80° C for the case where the respective photo-conductive materials are coated on the electrode or $SnO_2$ layer directly and on the ZnO layer of the invention, respectively.

As may be apparent from the above Table II, the sensitivity of the photo-conductive material consisting of Se : As is increased and the life time thereof is prolonged somewhat as the added amount of As is increased, but in any event life time itself is very short. Further, as the added amount of As increases to more than 20 weight %, the accmulation effect photoconductivity, which is well known in the material $As_2S_3$, appears.

On the contrary, with the photo-conductive material Se : $As_2S_3$ according to this invention, the appearance of the accumulation effect of photoconductivity is prevented and the life time is much prolonged without lowering the sensitivity. Further, when much prolonged without lowering the sensitivity. And, the life time in the case that photo-conductive material is directly coated on the ZnO layer, the life time is much prolonged as compared with the case that the photo-conductive layer is directly coated on the $SnO_2$ layer. A possible reason for the foregoing is that the arsenic and sulphur act to avoid the crystallization of the amorphous selenium within the layer 33, the ZnO layer acts to avoid crystallization at the surface of layer 33 of the amorphous selenium containing the arsenic and sulphur, and the crystallization of the amorphous selenium layer 33, as a whole, is further avoided. If too much $As_2S_3$ is added, the sensitivity is lowered, so that the added amount of $As_2S_3$ is preferred to be lower than 25 weight %.

Figure 5:
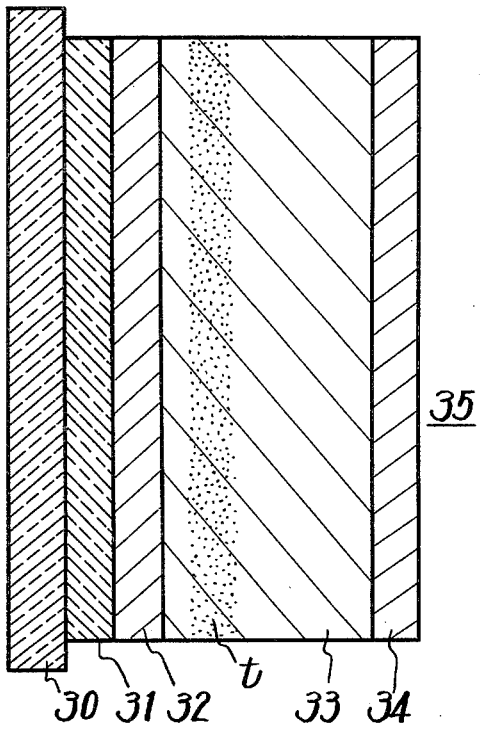
FIG. 5 is a cross-sectional view showing another embodiment of the target structure according to this invention.
Figure 6:
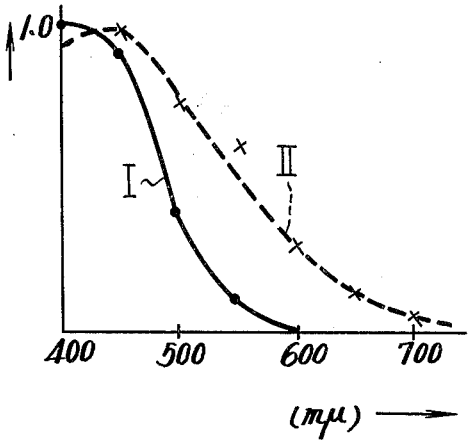
FIG. 6 is a graph showing the photo-sensitive characteristics of an image pickup tube in which the target structure shown in FIG. 5 is used.

FIG. 6 is a graph showing the photo-sensitivity characteristics of the image pickup tube in which the target structure according to this invention shown in FIG. 5 is employed. In the graph of FIG. 6, solid line curve I represents the case where the Se : AsS, which consists of the amorphous selenium the addition thereto of the arsenic and sulphur, is used as the photo-conductive material, and a dotted line curve II represents the case where the Se : AsSTe, which consists of the amorphous selenium with the arsenic, sulphur and tellurium, is used as the photo-conductive material. From the graph of FIG. 6, it may be apparent that the latter case, in which tellurium is used, can improve the sensitivity at the longer wavelength side.

Figure 7:
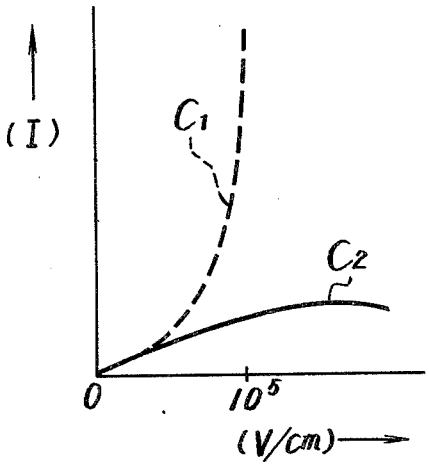
FIG. 7 is a graph showing the rectifying characteristics of the target structure shown in FIG. 5.
Figure 8:
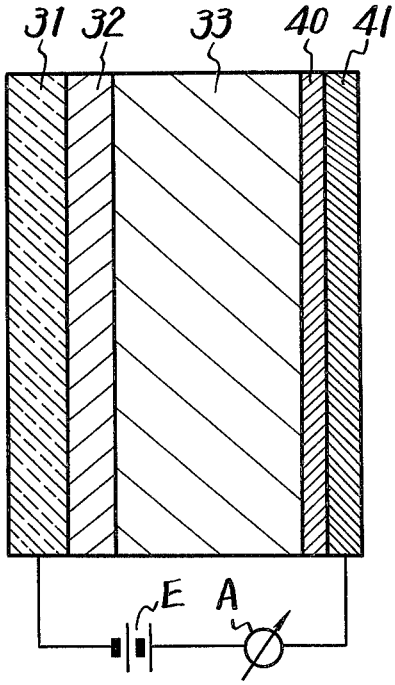
FIG. 8 is a schematic diagram showing one method of obtaining the characteristics of FIG. 7.

Further, in the target structure according to the present invention, diode characteristics appear in its target voltage versus current characteristics. FIG. 7 is a graph showing the target voltage versus current characteristics obtained in the following way: As shown in FIG. 8, the ZnO layer 32 is coated on the $SnO_2$ layer 31; the amorphous selenium layer 33 containing arsenic and sulphur is coated on the layer 32; a gold (Au) layer 40 is coated on the layer 33; an aluminium layer 41 is coated on the layer 40; and a current variation relative to the variation of a voltage E impressed between the layers 41 and 31 is measured by an ammeter A. In the graph of FIG. 7, a dotted line curve $C_1$ shows the voltage current characteristics for the case where the layer 31 is held as the negative electrode while a solid curve $C_2$ shows the voltage current characteristics for the case where the layer 31 is held as the positive electrode. The reason why the diode characteristics appear may be that the ZnO layer 32 is of the N-type and a PN-junction or heterojunction is formed at the contact surface between the layer 32 and the amorphous selenium (with tellurium) layer 33.

Figure 9:
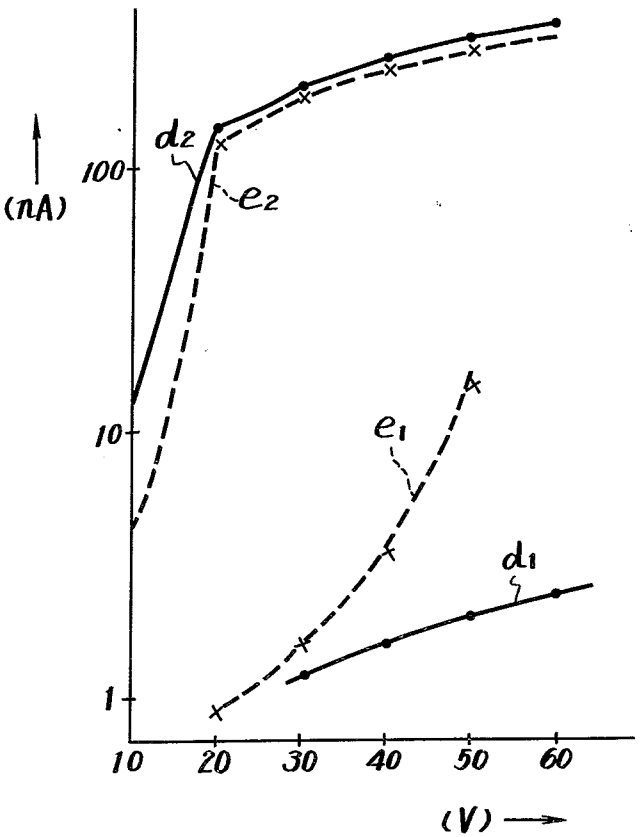
FIG. 9 is a graph showing the voltage current characteristics of an image pickup tube using the target structure shown in FIG. 5.

In the graph of FIG. 9, solid line curves $d_2$ and $d_1$ show the photo-current and dark current characteristics, respectively in the case that the amorphous selenium layer 33 is coated on the ZnO layer 32 which is, in turn, on the $SnO_2$ layer 31, as in FIG. 5, while dotted line curves $e_1$ and $e_2$ show the photo-current and dark current characteristics, respectively, when the amorphous selenium layer 33 is coated directly on the $SnO_2$ layer 31. In both cases, the photo-current characteristics are given for an intensity of illumination on the photo-conductive surface of 10 Lux.

As may be apparent from the graph of FIG. 9, the dark current characteristics in the case where the ZnO layer 32 is interposed between the amorphous selenium layer 33 and the $SnO_2$ layer 31 are much improved without changing the photo-current characteristics as compared with the case where the amorphous selenium layer 33 is coated directly on the $SnO_2$ layer 31. In general, when tellurium Te is added to the photo-conductive material, the dark current increases. However, according to the example of the present invention, even though the tellurium is added, the dark current is improved.

Figure 10:
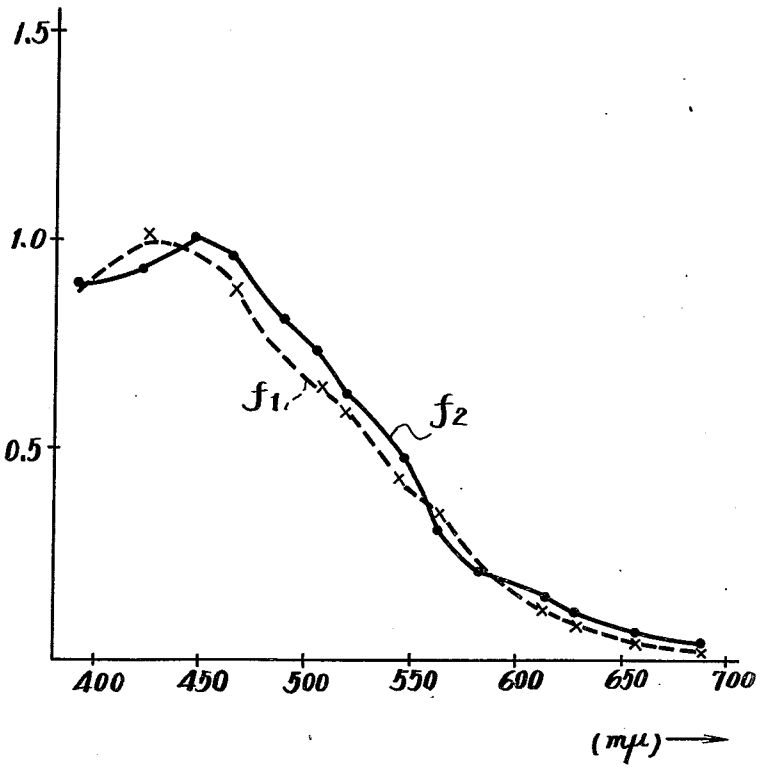
FIG. 10 is a graph showing the photo-sensitive characteristics of the image pickup tube using the target structure shown in FIG. 5.

FIG. 10 is a graph showing the photo-sensitivity characteristics of the image pickup tube using the target structure of the invention shown in FIG. 5. In the graph of FIG. 10, a dotted line curve $f_1$ shows the case in which the ZnO layer 32 is interposed between the amorphous selenium layer 33 and the $SnO_2$ layer 31, while a solid line curve $f_2$ shows the case in which the amorphous selenium layer 33 is coated directly on the $SnO_2$ layer 31. From the graph of FIG. 10, it will be seen that the photo-sensitivities are substantially the same in both cases.

From the above description it will be apparent that, according to this invention, a target structure for use with an image pickup tube is obtained in which the photo-conductive layer consisting mainly of the amorphous selenium is used to make the residual image low, the crystallization of the photo-conductive layer is prevented without lowering the sensitivity and the life time is much improved.

It will be apparent that many modifications and variations could be effected in the above described embodiments of the invention by one skilled in the art without departing from the spirit or scope of the novel concepts of the present invention.

We claim as our invention:

1. A target structure for an image pickup tube comprising a transparent substrate, transparent conductive layers on a surface of said substrate defining first and second comb-shaped electrodes having interfitting electrode elements and being connected to respective output terminals for deriving image information, a transparent zinc oxide layer formed on said conductive layers and having a resistivity between that of a conductor and an insulator, and a photo-conductive layer formed on said zinc oxide layer, said photo-conductive layer being of a P-type material which is either antimony trisulfide or which includes amorphous-selenium as a major proportion thereof.

2. A target structure according to claim 1; in which a major proportion of said P-type material is amorphous-selenium and said P-type material further includes sulphur and arsenic.

3. A target structure according to claim 2; in which the amount of said sulphur and arsenic, in the form of arsenic trisulfide, is between 5 and 25 weight %.

4. A target structure according to claim 3; in which said P-type material further includes tellurium.

5. A target structure according to claim 1; in which said photo-conductive layer is formed of antimony trisulfide.

6. A target structure according to claim 1; further comprising a color filter at the surface of said substrate remote from said conductive layer, said color filter including stripe-shaped, parallel filter regions transmitting respective different wavelength bands of light and being arranged in a repeating cyclic order of a predetermined pitch.

7. A target structure according to claim 6; in which said interfitting electrode elements of said one electrode and said other electrode extend parallel to said stripe-shaped filter regions of said color filter and have a pitch equal to said predetermined pitch of said repeating cyclic order.

8. A target structure according to claim 1; in which said zinc oxide layer has a surface resistivity in the range between $106^6$ Ω/square and $10^{15}$ Ω/square.

* * * * *